US005349799A

United States Patent [19]

Schiedegger et al.

[11] Patent Number: 5,349,799

[45] Date of Patent: Sep. 27, 1994

[54] PLASTIC GABLE VENT

[75] Inventors: Charles E. Schiedegger, Metamora; Richard J. MacLeod, Milford, both of Mich.

[73] Assignee: Mid-America Building Products Corporation, Plymouth, Mich.

[21] Appl. No.: 111,986

[22] Filed: Aug. 25, 1993

[51] Int. Cl.[5] ..... F24F 13/08

[52] U.S. Cl. ..... 52/473; 52/199; 52/302.1; 52/209; 454/277; 454/283

[58] Field of Search ..... 52/473, 302.1, 198, 52/199, 95, 209; 454/277, 283

[56] References Cited

U.S. PATENT DOCUMENTS

| | | | |
|---|---|---|---|
| 2,956,496 | 10/1960 | Simblest | 454/283 |
| 3,087,412 | 4/1963 | Holmes | 454/277 |
| 4,785,596 | 11/1988 | Wiley et al. | 52/198 |
| 4,875,317 | 10/1989 | Logan et al. | 52/473 X |
| 4,875,318 | 10/1989 | MacLeod . | |
| 4,899,647 | 2/1990 | Garries . | |
| 4,911,066 | 3/1990 | Carew | 52/473 X |

*Primary Examiner*—Carl D. Friedman
*Assistant Examiner*—Robert J. Canfield
*Attorney, Agent, or Firm*—Barnes, Kisselle, Raisch, Choate, Whittemore & Hulbert

[57] ABSTRACT

A plastic gable vent for placement on the wall of a building to provide a louver wherein siding abuts the gable vent comprising a plastic body having a front wall and a peripheral wall circumscribing the front wall. A plurality of integral longitudinally spaced louvers are provided on the front wall. Each louvers includes an inwardly extending apex with side walls, one of which has a slot therein. The plastic body further includes an inner peripheral wall that circumscribes the louvers. A flat sheet is attached on the plastic body and overlies the inwardly extending apices. The screen is opaque and formed with vertically spaced slots when mounted on the inner peripheral wall, opaque portions engage the inner apices of the louvers, and the slots are positioned such that they are spaced transversely from the walls that have the openings therein. A screen overlies the flat sheet. A movable flange member is telescoped over the peripheral wall of the body and includes a laterally extending flange adapted to overlie portions of abutting siding or the like . The flange member and the outer peripheral wall include interengaging portions for selectively positioning the flange member. The plastic body includes a laterally extending flange for mounting the plastic body on the wall of a building.

5 Claims, 2 Drawing Sheets

PLASTIC GABLE VENT

This invention relates to plastic building products for attachment to the wall of a building having siding thereon and particular to a gable vent.

BACKGROUND AND SUMMARY OF THE INVENTION

It has heretofore been suggested that one piece plastic louvers or windows can be provided by vacuum forming plastic so that a peripheral wall of the product circumscribes the louver or window and a laterally extending flange serves as a means for attachment to the wall of the building. It is common to use a J-channel in abutment with such a product to overlie the free edges of siding that abut the product. It has also been suggested that an integral channel be provided for receiving the siding.

In U.S. Pat. No. 4,875,318, there is disclosed a plastic building product for placement on the wall of a building to provide a louver or window wherein siding abuts the product comprising a plastic body having a peripheral wall circumscribing the louver or window, an integral flange extending laterally from the wall for fastening the body to the wall of a building, and a movable flange member telescoped over the peripheral wall of the body and including a laterally extending flange which is adapted to overlie portions of abutting siding or the like. The flange member and the peripheral wall include interengaging means for selectively positioning the flange member at predetermined distances with respect to the flange on the body to accommodate siding of varying thickness.

In such a building product incorporating louvers, when the product is made in injection molds, in order to facilitate formation of the apices of the louvers, each louver has an apex and side walls and the side walls are at an angle to perpendicular axes. In such a construction, openings in one of the side walls can permit viewing of the raw or uncovered wall of the building. It is conventional in such a construction to place the screen on the peripheral flange in order to prevent insects and the like from entering the building.

Among the objectives of the present invention are to provide a plastic gable vent which obviates the objections inherent in the aforementioned gable vent wherein a person viewing the gable vent at a particular angle may see the raw inside wall of the building; wherein the gable vent minimizes the passage of blowing rain and snow through the vent; wherein the gable vent prevents the entry of inserts such as wasps and bees; wherein the resultant gable vent provides a more aesthetic appearance; and wherein the gable vent requires a much lesser amount of screen material thereby reducing the costs.

In accordance with the invention, a plastic gable vent for placement on the wall of a building to provide a louver wherein siding abuts the gable vent comprises a plastic body having a front wall and a peripheral wall circumscribing the front wall. A plurality of integral in longitudinal spaced louvers are provided on the front wall. Each louver includes an inwardly extending apex with side walls, one of which has a slot therein. The plastic body further includes an inner peripheral wall that circumscribes the louvers. A flat sheet is attached on the plastic body and overlies the inwardly extending apices. The screen is opaque and formed with vertically spaced slots when mounted on the inner peripheral wall, opaque portions engage the inner apices of the louvers, and the slots are positioned such that they are spaced transversely from the walls that have the openings therein. A screen overlies the flat sheet. A movable flange member is telescoped over the peripheral wall of the body and includes a laterally extending flange adapted to overlie portions of abutting siding or the like. The flange member and the outer peripheral wall include interengaging portions for selectively positioning the flange member. The plastic body includes a laterally extending flange for mounting the plastic body on the wall of a building.

DESCRIPTION

Figure 1:
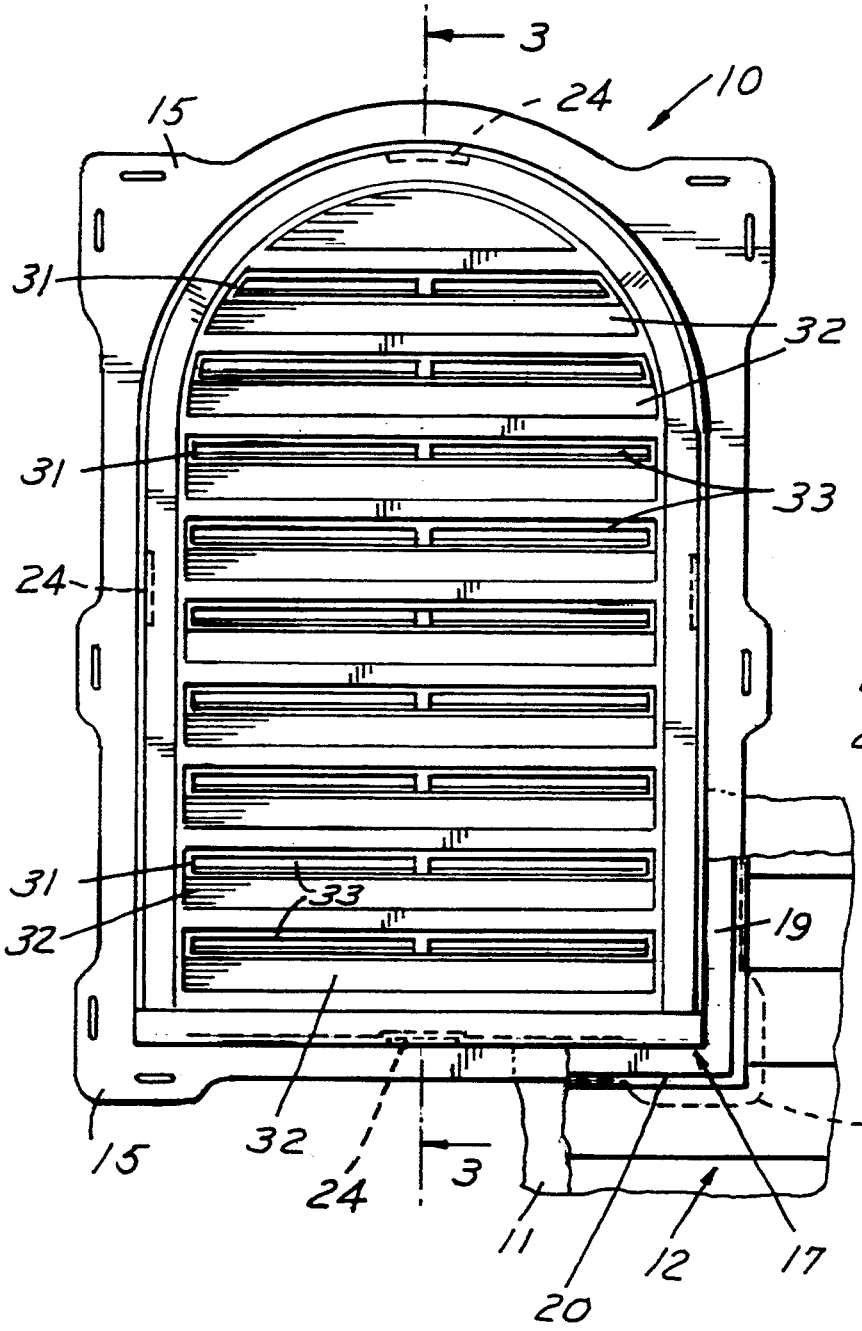
FIG. 1 is an elevational view of a gable vent embodying the invention.
Figure 2:
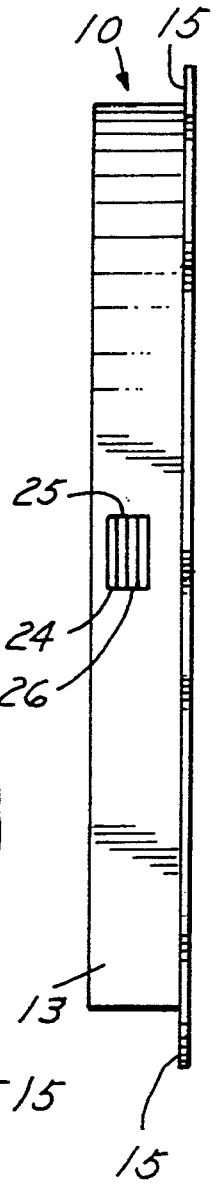
FIG. 2 is a side elevational view thereof.
Figure 4:
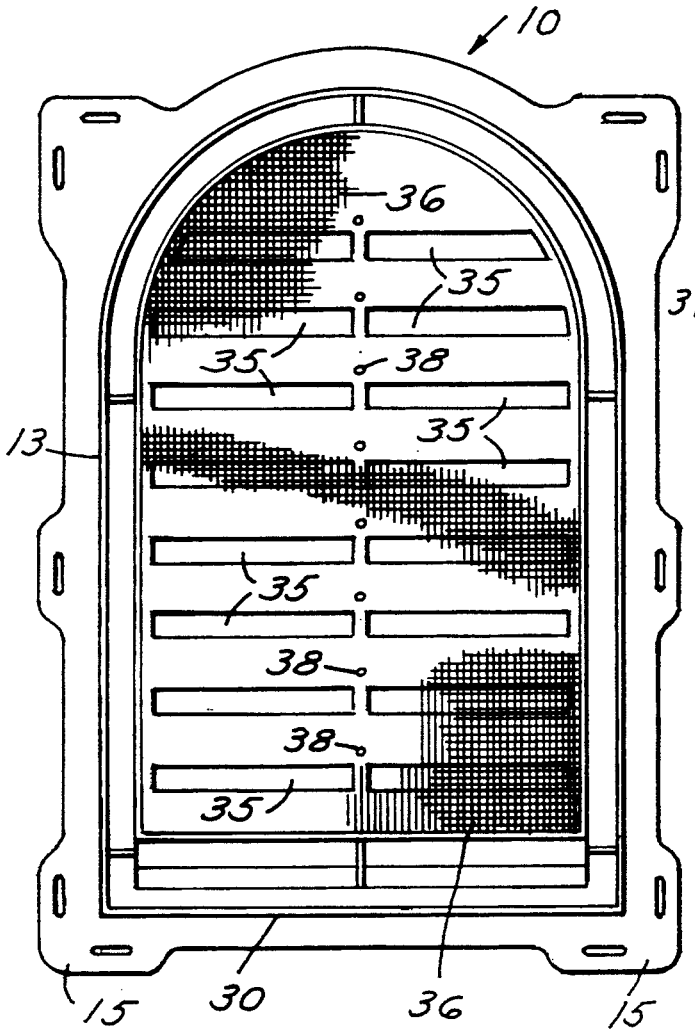
FIG. 4 is a rear view of the screen used in the gable vent.
Figure 3:
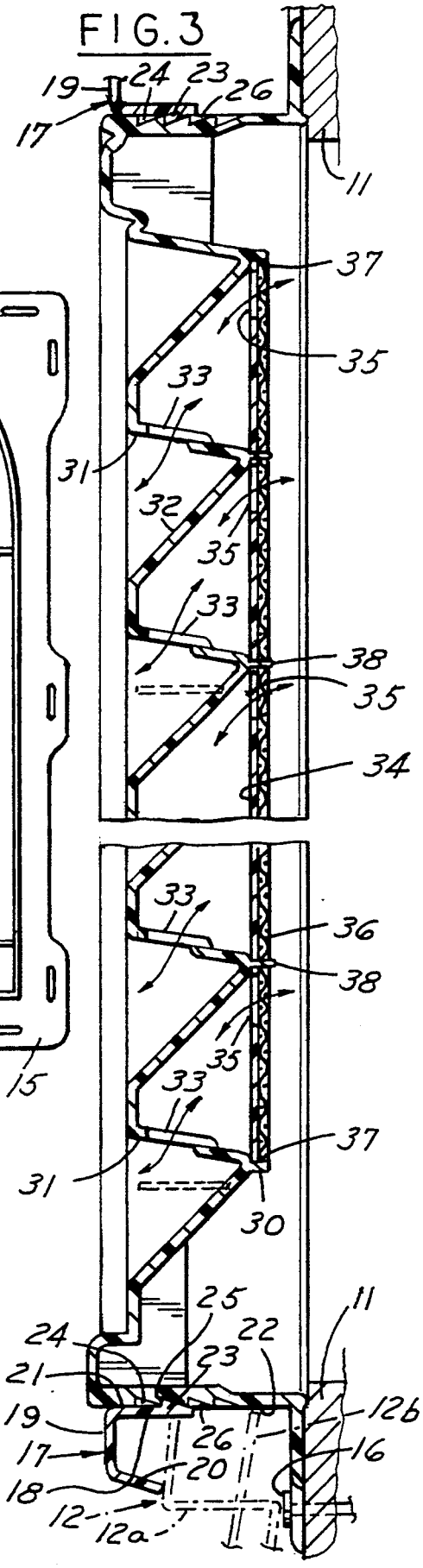
FIG. 3 is a sectional view taken along the line 3—3 in FIG. 1.

Referring to FIGS. 1–4, in accordance with the invention, a plastic building product 10 embodying the invention is adapted to be mounted in a wall 11 having siding 12 of aluminum, plastic or the like (FIG. 3). The body 10 includes a continuous peripheral wall 13 that extends axially and circumscribes a louver which is integral with the body 10. The body of the product 10 further includes a peripheral flange 15 which abuts the building wall 11 for attachment as by nails or screws 16.

The plastic building product further includes an annular flange member 17 that has an internal configuration corresponding to the external configuration of the peripheral wall 13. The wall 13 is, herein shown as circular, part circular, non-circular or other configuration. The member 17 includes a continuous axial wall 18 in telescoping relation the wall 13 and an integral flange 19 having a lip 20 adapted to engage the siding 12. Interengaging means are provided on the inner surface 21 of the wall 18 of the flange member 17 for engagement with the external surface 22 of the wall 13 to selectively position the flange member 17 in predetermined spaced relationship with respect to the flange 15 in order to accommodate siding of various axial thickness as shown at **12*a* and 12*b* in FIG. 4. The interengaging means is herein shown as tooth 23 on the inner surface of the wall 18 and a plurality of circumferentially spaced teeth in the form of complementary recesses or grooves 24, 25 26 on wall 13 adapted to selectively engaged by the rib 23**.

A tooth 23 is preferably provided at circumferentially spaced points along the wall, as four in number. Similarly, an equal number of sets of recesses 24, 25, 26 are provided on wall 13. Teeth 23 and recesses 24, 25, 26 are provided an they have nonsymmetrical cross sections which are unsymmetrical cross sections such that when the flange member 18 is moved axially inwardly it causes the teeth 23 to successively engage the teeth 24, 25, 26 until the flange member 18 abuts the siding.

In practice, the flange member 17 may be shipped apart from body 10. When delivered to the job site, the body 10 is applied to the wall and the siding is then applied. The flange member 17 is then moved axially inwardly to engage the teeth 24, 25 or 26 until the flange member 17 engages the siding. When the teeth 23 are in engagement with one of the ribs of teeth 24, 25, 26, the wall 18 of the retaining member 17 is in flush engagement with wall 13 of body 10.

The aforementioned construction is substantially that shown in U.S. Pat. No. 4,875,5318 incorporated herein by reference.

In accordance with the invention, the plastic body includes an inner peripheral wall 30 forming part of the front wall and defining inwardly extending apices, each apex having two inclined walls 31, 32, the lower wall 31 being formed with an opening 33.

Further, in accordance with the invention, a black flat sheet 34 is attached on the plastic body and overlies the inwardly extending apices. The sheet 34 is opaque and formed with vertically spaced slots 35. A screen 36 overlies the flat sheet 34. The slots 35 are positioned such that they are positioned adjacent walls 31. Screen 34 is welded by heat, as by a hot plate, about its periphery to the shoulder 37 formed on the interior surface of the wall 30. Where the gable vent is large, additional plastic projections 38 are provided at some of the apices which are fused by heat, as by a hot plate, to support the screen at intermediate points.

When in position as shown in FIG. 3, venting is permitted from the interior as well as air movement toward the interior in sinuous paths as shown by the arrows. In addition, the opaque dark or black sheet 34 obstructs vision of a viewer such that any raw inside wall of a building is not visible. The screen prevents entry of insects.

It can thus be seen that there has been provided a gable vent wherein a person viewing the gable vent at a particular angle may see the raw inside wall of the building; wherein the gable vent minimizes the passage of blowing rain and snow through the vent; wherein the gable vent prevents the entry of inserts such as wasps and bees; wherein the resultant gable vent provides a more aesthetic appearance; and wherein the gable vent requires a much lesser amount of screen material thereby reducing the costs.

We claim:

1. A plastic gable vent for placement on the wall of a building to provide a louver wherein siding abuts the gable vent comprising a plastic body having a front wall and a peripheral wall circumscribing the front wall, a plurality of integral longitudinally spaced louvers are provided on the front wall, each louver includes an inwardly extending apex with side walls, one of which has a slot therein, said plastic body further including an integral inner peripheral wall that circumscribes the louvers, a generally planar plastic member having a darker color than the color of the plastic body mounted on the inner periphery wall and engaging the inner apices of the louvers, said planar member including slots that are spaced transversely from the walls of the apices having the openings therein, a screen is mounted in overlying relationship to said planar member on the inner peripheral wall and spanning the inner apices, a movable flange member telescoped over the peripheral wall of the body and including a laterally extending flange adapted dot overlie portions of abutting siding or the like, said flange member and the outer peripheral wall including interengaging portions for selectively positioning the flange member, said plastic body including a laterally extending flange for mounting the plastic body on the wall of a building.

2. The plastic gable vent set forth in claim 1 wherein each said slot in said planar member is adjacent an apex.

3. The plastic gable vent set forth in claim 2 wherein said screen member is bonded to said peripheral wall.

4. The plastic gable vent set forth in claim 2 wherein said screen member is bonded to said peripheral wall by ultrasonic welding.

5. The plastic gable vent set forth in claim 4 wherein at least some of said apices include integral projections fused to said screen.

* * * * *